US005466474A

United States Patent [19]

Gaylor

[11] Patent Number: 5,466,474

[45] Date of Patent: Nov. 14, 1995

[54] METHOD AND APPARATUS FOR MANUFACTURING INFUSION PACKAGES

[75] Inventor: Ian M. D. Gaylor, Nr. Grantham, England

[73] Assignee: A.G. (Patents) Limited (British company), London, England

[21] Appl. No.: 211,491

[22] PCT Filed: Oct. 9, 1992

[86] PCT No.: PCT/GB92/01842

§ 371 Date: Jun. 7, 1994

§ 102(e) Date: Jun. 7, 1994

[87] PCT Pub. No.: WO93/07060

PCT Pub. Date: Apr. 15, 1993

[30] Foreign Application Priority Data

Oct. 9, 1991 [GB] United Kingdom ..... 9121419

[51] Int. Cl.[6] ..... B65B 29/04

[52] U.S. Cl. ..... 426/394; 426/80; 53/413; 53/449; 53/451; 53/134.2; 53/546; 53/548

[58] Field of Search ..... 426/71, 80, 81, 426/82, 83, 84, 431, 432, 433, 435, 394; 53/413, 449, 451, 134.2, 546, 554, 548; 206/0.5

[56] References Cited

U.S. PATENT DOCUMENTS

| | | | |
|---|---|---|---|
| Re. 25,839 | 8/1965 | Stroop | 53/546 |
| 2,083,617 | 6/1937 | Salfisberg | 53/554 |
| 2,350,930 | 6/1944 | Salfisberg | 53/413 |
| 2,377,118 | 5/1945 | Weisman | 426/77 X |
| 2,608,405 | 8/1952 | Salfisberg et al. | 53/546 X |
| 2,673,430 | 3/1954 | Fleischer et al. | 53/546 |
| 2,730,852 | 1/1956 | Clark | 53/546 |
| 3,077,063 | 2/1963 | Stroop | 53/546 |
| 3,210,908 | 10/1965 | Somberg | 53/546 |
| 3,316,686 | 5/1967 | Welin-Berger | 53/449 X |
| 3,383,269 | 5/1968 | Kopp | 53/546 X |
| 3,596,428 | 8/1971 | Young et al. | 53/28 |
| 3,641,737 | 2/1972 | Tamagni | 53/554 |
| 3,846,569 | 11/1974 | Kaplan | 426/77 X |
| 4,646,510 | 3/1987 | McIntyre | 53/449 |
| 4,726,956 | 2/1988 | Christie | 426/80 |
| 4,853,071 | 8/1989 | Romagnoli | 53/134.2 X |
| 4,856,257 | 8/1989 | Romagnoli | 53/134.2 |
| 4,880,651 | 11/1989 | Christie | 426/394 |
| 5,233,813 | 8/1993 | Kenney et al. | 53/450 |

FOREIGN PATENT DOCUMENTS

| | | | |
|---|---|---|---|
| 0095542 | 12/1983 | European Pat. Off. . | |
| 674886 | 7/1952 | United Kingdom . | |
| 1245359 | 9/1971 | United Kingdom . | |
| 2201935 | 9/1988 | United Kingdom . | |
| 9000497 | 1/1990 | WIPO . | |
| 9215500 | 9/1992 | WIPO | 426/77 |

*Primary Examiner*—Steven Weinstein
*Assistant Examiner*—Milton I. Cano
*Attorney, Agent, or Firm*—Charles E. Baxley

[57] ABSTRACT

A traveling web (11) having adjacent rows of infusion containing pockets (7) has a strip of web material (20) removed from between these rows to produce strips (19) of pockets (7) which are then attached to a cover member. The strip removal is achieved by co-rotating cutting wheels (26, 36) having co-operating shearing edges (32, 33, 34, 37). Removed strips (20) are guided into vacuum ducts (40) by fingers (41).

21 Claims, 6 Drawing Sheets

METHOD AND APPARATUS FOR MANUFACTURING INFUSION PACKAGES

The present invention relates generally to infusion packages such as tea and coffee bags and similar bags containing herbal or other infusions. Specifically the invention relates to a method and apparatus for manufacturing infusion packages having a cover attached thereto, comprising joined leaves extending over opposed surfaces of the package.

A covered infusion package is disclosed in GB-A-2167380. That package has a cover formed by two leaves joined at a fold line, the package being secured to one of the leaves by heat sealing below the fold line. The leaves extend beyond the edges of the package around its complete periphery. In use the package is suspended over the edge of a cup by folding back the leaves which are then placed outside the cup. Once the infusion is complete, the package is removed from the cup by the leaves which are then folded over the package to allow the residue to be squeezed from the package, if desired, and also to allow a user conveniently to dispose of the package.

WO-90/00497 disclose machines for manufacturing such packages, in which individual packages are heat sealed to a web of cover material which at the same time is cut to the correct length for forming individual covered packages. The machine disclosed is a single lane machine, i.e. it produces only a single line of packages. In practice to increase production rates, it is desirable to produce several lines of packages at once in a so-called multi-lane machine. Indeed WO 90/00497 does mention this possibility. In a known multi-lane machine, developed from that shown in WO 90/00497, an intermittently moving two-ply web of successive rows of infusion packages is cut longitudinally and transversely by a blade and anvil arrangement to produce a row of packages severed from the end of the web. The packages, which have no transverse spacing between them, are then lifted together by vacuum means onto a number of conveyors which diverge from one another so as transversely to space the packages from one another. At the end of the respective conveyors, the packages are pulled by flighted conveyors into respective trays which introduce the package to respective parallel welding stations where they are heat sealed onto respective cover members, as shown in the specification. Due to the transverse spacing between the packages, they may be attached to the respective covers so that they lie wholly inside the periphery of the cover. However, in such an arrangement it has been found that due to irregularities in conveyor speeds, for example, the packages on the diverging conveyors may lose registry with one another and become skewed relative to each other, which means that they may not be successfully introduced to their respective welding stations, and thus cause a blockage in the machine which must then be stopped to clear the blockage.

The present invention seeks to overcome the above problems, and provides, from a first aspect, a method of manufacturing infusion packages provided with a cover which projects laterally beyond the package and has a pair of joined leaves, comprising forming in a travelling two-ply porous web, successive rows of infusion containing pockets extending transversely to the direction of travel of the web and spaced apart by transversely extending sealed regions of the web, removing a continuous strip of web material from the longitudinal sealed region extending between respective pockets of said rows to form a plurality of parallel transversely spaced travelling strips of infusion pockets, cutting said strips along the transversely extending sealed regions to form the pockets into individual infusion packages, and attaching a cover to said packages.

From a second aspect the invention provides apparatus for manufacturing infusion packages each having a cover which projects laterally beyond the package and has a pair of joined leaves, comprising means for forming in a travelling two-ply web successive rows of infusion containing pockets extending transversely to the direction of travel of the web and spaced apart by transversely extending sealed regions of the web, means for removing a continuous strip of web material from the longitudinal sealed region between the respective pockets of each row to form a plurality of parallel, transversely spaced travelling strips of infusion containing pockets, means for cutting said strips along said transversely extending sealed regions to form individual infusion packages, and means for attaching covers to said packages.

Thus in accordance with the invention a longitudinally extending strip of material is removed from between adjacent pockets on the web to define a lateral spacing between the packages for subsequent attachment to a cover. This obviates the need for diverging streams of packages, and thus avoids the problems stated above. It will also be appreciated that the packages will be transferred towards the cover-applying means as a strip, which greatly facilitates their handling and ensures a more positive transverse location of the packages which means that they may be more accurately positioned on the cover material.

The travelling web of infusion containing pockets may be produced in any convenient manner by known machinery, and is preferably continuously moving whereby continuously moving strips of pockets will be produced. This will increase the number of packages produced, compared to an intermittent feed process, and the present invention greatly facilitates the use of a continuously moving web of packages.

The width of the strip of material removed from between adjacent infusion containing pockets is chosen such that after attachment of a cut package to the cover, the cover will overlap the edge of the package by a desired amount. The outer edges of the web of packages may also be trimmed if necessary to ensure that the correct cover overlap is obtained in the outermost packages of the row.

The strip of web material may be removed from between adjacent infusion containing pockets by any convenient means for example cutting. In one arrangement the strip is "crush" cut by cutting means comprising a rotating cutting wheel having transversely spaced upstanding cutting edges on its outer periphery which co-operate under pressure with the surface of a co-rotating plain anvil wheel. Preferably however, the strip is removed by shear cutting, co-rotating cutters being provided with co-operating shearing cutting edges. This is found to give a cleaner cut.

Preferably means is provided for conducting the strips of waste web away from the cutters. In one embodiment, the strips are removed by vacuum means. A vacuum duct may be placed closely adjacent the cutters, the strips then being sucked into the duct. Conveniently, respective ducts are provided at the respective cutters each to receive a single strip of waste web. Means may be provided, if necessary, positively to guide a waste strip into the removal means to prevent the waste from becoming entangled with the cutters.

After the web of infusion containing pockets has been cut into separate, transversely, spaced strips, the infusion packages thus formed are attached to a suitable cover material. At some point the strips of pockets are cut transversely to define individual packages, and this may be done either before or after the package is attached to its cover. Preferably, however, it is done before attachment to the cover as will be described later.

The cover material is preferably supplied to the cover attachment means in the form of a web of suitable material which is preferably continuously moving. The material may be an impervious, insulating, material such as styrene. After a package has been attached to the web, the web may then be cut transversely to produce individual covered packages. Although it would be possible to provide a separate strip like web of cover material for each strip of infusion packages, it is preferred to supply the cover material as a web which extends across a plurality and preferably all, of the strips. The packages will then be attached to the web of cover material in parallel rows across the web which is then cut both transversely and longitudinally to produce individual covered packages. Such an arrangement will reduce the amount of material initially to be removed from between the packages since no allowance need be made for spacing of adjacent webs of cover material. This will also lead to a more compact construction of apparatus, and will be more simple to control than an arrangement with multiple webs of cover material. It will also be appreciated that the present invention facilitates the accurate positioning of the packages on the web of cover material.

In a preferred embodiment, the packages are heat sealed onto the web(s) of cover material. Thus, means may be provided for melting or welding the cover material and/or any fusible coating on the package. Preferably such means comprises a heated rotary member having one or more welding heads which co-operate, under cover material passing together between the sealing head and the anvil to be joined together. Such an arrangement allows for continuous feed of the web of cover material, and thus a high production rate.

When the web of the cover material is fed continuously, for a satisfactory join to be obtained between the web and the package, the package and the web should travel through the welding head at the same speed so as to minimise stresses at the point of attachment. However, the average speed of supply of the web of cover material will be approximately twice that of the supply of infusion packages since each cover comprises two joined leaves, each leaf extending over a respective surface of the package. Thus either the speed of the web of cover material must be temporarily reduced to match that of the packages or, more preferably, the packages are accelerated to match the speed of the web of cover material. The packages must be attached to the web of cover material at a suitable gap from one another to allow the cover material subsequently to be folded over the package. This gapping is also achieved preferably by controlling the speed of supply of either the packages or the web of cover material.

This aspect forms the subject of our further application filed on the same date and entitled "Manufacturing Infusion packages".

It is preferred to accelerate the speed of the packages to match that of the web of cover material, which is preferably supplied at a constant speed. The packages must first be cut from their respective strips, preferably by-co-rotating cutting rollers having co-operating cutting surfaces thereon, which cut the strips transversely. More than one cutting means may be provided on each roller.

The packages are preferably accelerated by co-rotating rollers which grip the package, preferably by its longitudinal peripheral seal and move it to the cover attachment means, for example the rotating welding head. The operation of the acceleration means is synchronised with that of the welding head and the cutting rollers.

At the attachment means the packages and the web of cover material are moving together at the same speed and are joined together, in the preferred embodiment, by a rotary welding head. Thereafter the package is carried with the web, which is then cut longitudinally and transversely into individual lengths of cover material each having a package attached thereto. The covers may then be folded over the package about a hinge line to complete the process. In one embodiment, the unfolded package is carried along a conveyor with the package occupying the rear part of the cover. A cam lifts the leading edge of the cover into a guide which as the cover passes along the conveyor folds the front half of the cover back over the package. The covered packages may then be loaded into cartons by convenient means.

The hinge line in the cover is preferably formed in the web of cover material before the package is attached to the web. Conveniently this may be done by forming a number of perforations across the web, for example using a rotary perforating blade. The operation of which is synchronised with the attachment means and the acceleration means whereby the package will be attached to the web of cover material in the correct position relative to the hinge line. Advantageously for some materials, for example foamed styrene, the blade is heated, and it may in a preferred embodiment co-operate with the same anvil roller as does the welding head.

In certain circumstances, for example in the coffee bags, it is desirable to seal the bag. This may be achieved in a preferred embodiment by for example, heat sealing the edges of the respective cover leaves together around their complete periphery.

The invention extends to a covered infusion package formed by a method and apparatus as described above.

A preferred embodiment of the invention will now be described by way of example only, with reference to the accompanying drawings in which.

Figure 1:
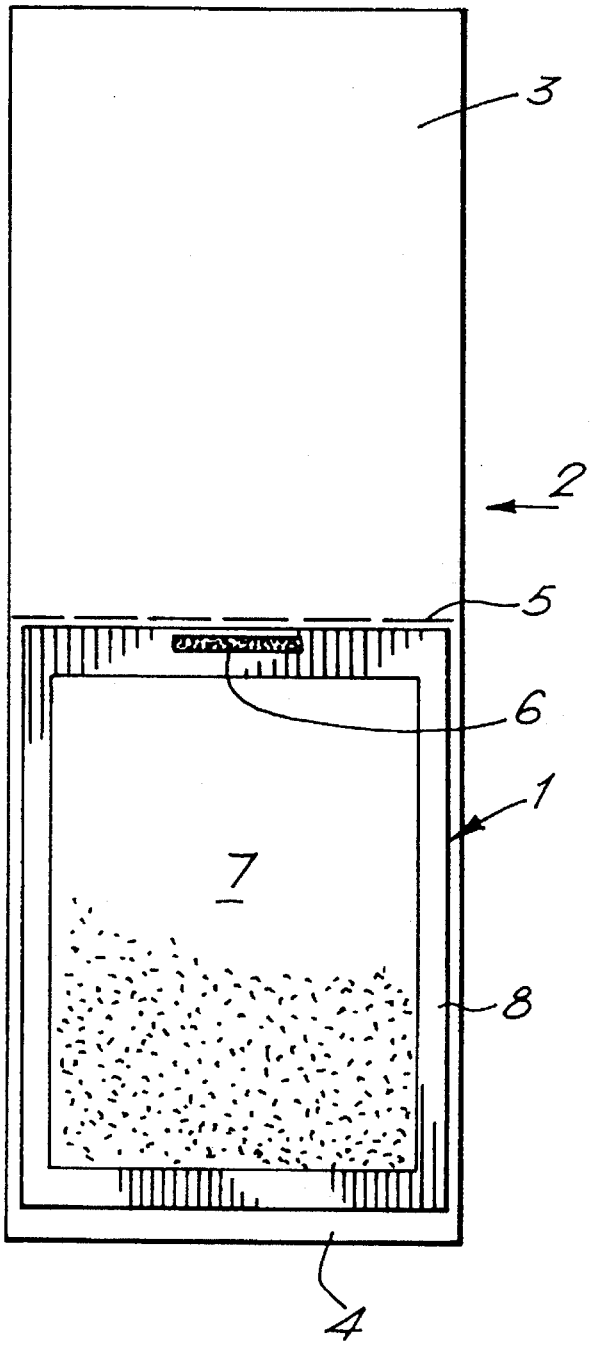
FIG. 1 is a plan view of a covered infusion package, with its cover folded back.
Figure 2:
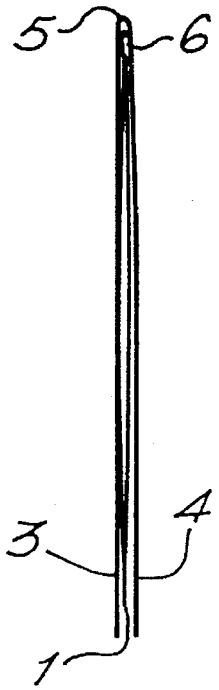
FIG. 2 is a side view of the infusion package of FIG. 1 with its cover folded into position.

FIGS. 1 and 2 show an infusion package 1 provided with a cover 2 having leaves 3,4 joined about a hinge line 5. The infusion package 1 is attached to the cover leaf 4 by a weld 6. The leaves 3,4 overlap the edges of the infusion package 1 around its entire periphery. As is well known in the art, the infusion package 1 comprises two webs of thermoplastics coated tissue which are heat sealed to each other around an infusion containing pocket 7 to define a land 8 around the periphery of the pocket. When it is desired to brew an infusion, the cover leaf 3 is folded back to lie behind cover leaf 4 and the package 1 placed in a cup, the leaves 3,4 hanging over the edge of the cup. Once the infusion has brewed, the cover leaf 3 is folded back over the package 1 as shown in FIG. 1 to squeeze any residue from the package for subsequent disposal of the package 1 in a clean manner.

Figure 3:
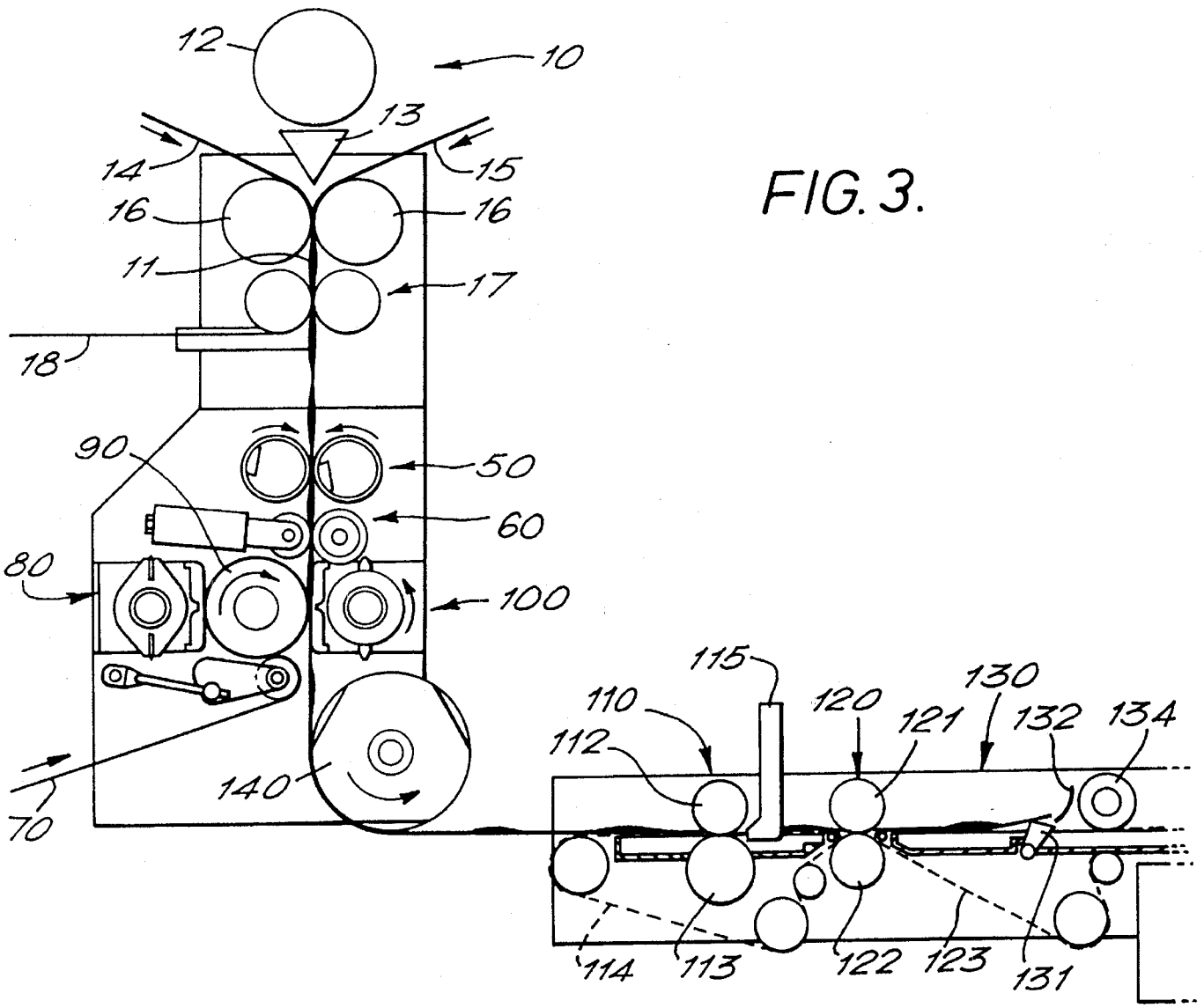
FIG. 3 is a schematic side view of an embodiment of the invention.
Figure 6:
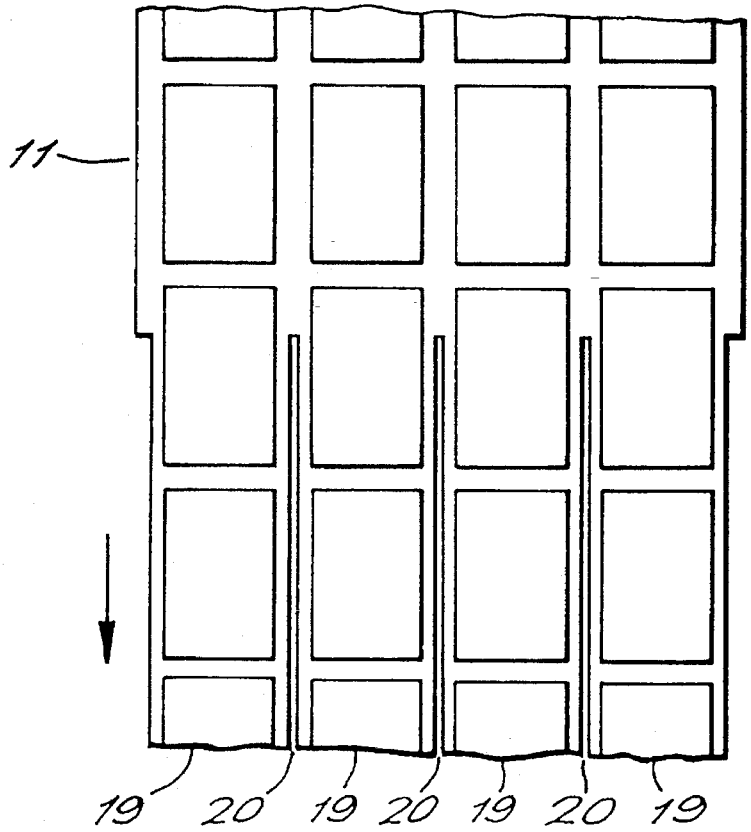
FIG. 6 shows a web of infusion packages at an intermediate step in the method of the invention.
Figure 7:
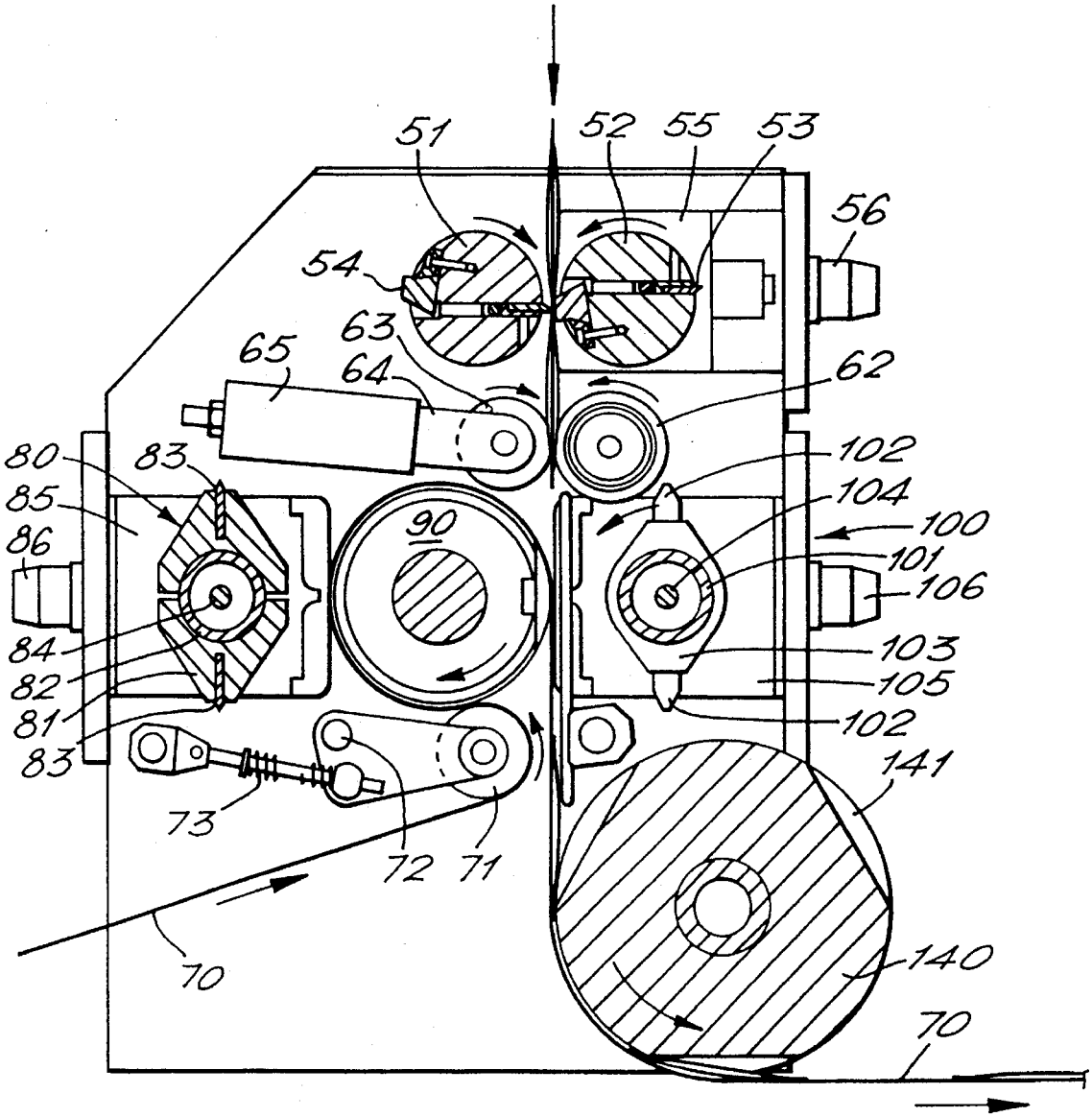
FIG. 7 is a side view of a further part of the apparatus shown in FIG. 3.

Referring now to FIG. 3, a machine for producing infusion packages as shown in FIGS. 1 and 2 comprises means 10 for producing a travelling two-ply web 11 containing successive rows of infusion containing pockets 7 extending transversely to the direction of movement of the web 11 (FIG. 6).

The travelling web 11 is then fed continuously, at constant speed, to means 17 for removing waste strips 18 of material from the longitudinally extending sealed regions between adjacent pockets to form a plurality of travelling strips 19 of infusion containing pockets. The strips 19 then pass to transverse cutting device 50 which cut the strips 19 into individual packages.

At the same time, a single web of cover material 70 is fed at constant speed via hinging means 80 over an anvil roller 90 to welding means 100. It will be apparent that the web 70 will be travelling at approximately twice the speed of the strips 19 of infusion containing pockets since a length of web 70 of approximately twice the length of an infusion package is required to produce a covered package. It is also desirable that as the packages and web move through the welding means 100 they are travelling at the same speed. Accordingly the packages cut from the respective strips 19 are accelerated by means 60 arranged between the transverse cutting device 50 and the welding means 100, which also introduces a gap between successive packages.

The welding means 100 attaches the transversely adjacent packages to the web 70, whereafter the web 70 is split longitudinally by longitudinal cutting means 110 and then transversely by transverse web cutting means 120, to produce a plurality of individual lengths of cover having a package attached to the rear upper surface thereof. The front portion of the cover is then folded over the package 1 at a folding station 130, whereafter the packages may be removed for packaging.

The process and apparatus will now be described in greater detail with reference to FIGS. 3 to 8 of the description.

As stated earlier, means 10 is provided for producing a travelling two-ply web containing successive rows of infusion containing pockets 7 (see FIG. 6).

Such means is known in the art and comprises a rotary dosing head 12 (FIG. 3) which doses measured amounts of infusion into a plurality of hoppers 13 arranged across webs 14,15 of thermoplastics coated tissue material. The hopper 13 reciprocates vertically and drops the measured doses of infusion between the webs 14,15, which are continuously fed into the nip between co-rotating heat sealing rollers 16. Raised regions (not shown) on the rollers 16 co-operate to seal the webs 14,15 to form rows of packages 1 comprising infusion containing pockets 7 defined by longitudinally and transversely extending sealed regions 8 at their peripheries.

The two-ply web 11 is then conducted to longitudinal cutting means 17 for removing strips 18 of web material from between the adjacent pockets 7 to form respective strips 19 of packages with gaps 20 between them. The strip removal means 17 is shown in greater detail in FIGS. 4 and 5 and comprises co-rotating cutting means 21 and means 22 for removing the waste strips 18.

The cutting means 21 comprises co-rotating shafts 23,24 journaled at their ends in supports 25 and driven through meshing gears 26. Shaft 23 mounts respective cutting wheels 27–31, which rotate with the shaft 23 and are adjustably arranged at a desired spacing from one another. The inner wheels 28–30 are each provided with two peripheral cutting edges 32,33, while the outermost wheels 27,31 each have a single cutting edge 34. Shaft 24 slidably mounts respective pairs of inner cutting wheels 35 and outer cutting wheels 36 the wheels rotating with the shaft 24. Each cutting wheel 35,36 has a single cutting edge 37 which co-operates with a respective cutting edge 32,33,34 on the cutting wheels 27–31 to define, as the wheels rotate, co-operating shearing Gutting edges for removing the strips 18 from between the packages and also at the edges of the web 11. Coil springs 38 press the wheels 35,36 mounted as shaft 24 against the sides of the wheels 27–31 mounted on shaft 23.

Figure 4:
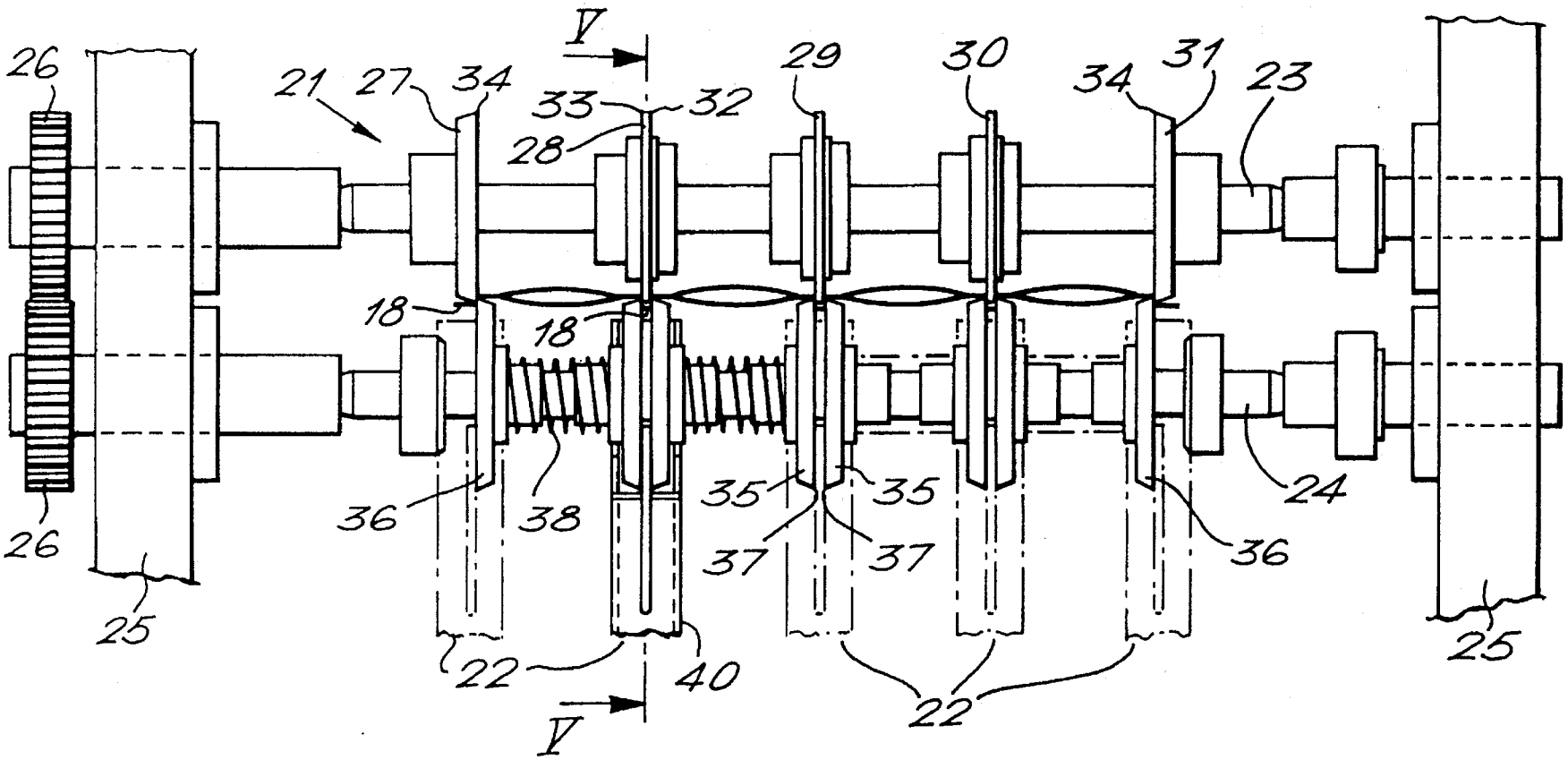
FIG. 4 is a plan view of part of the apparatus of FIG. 3.
Figure 5:
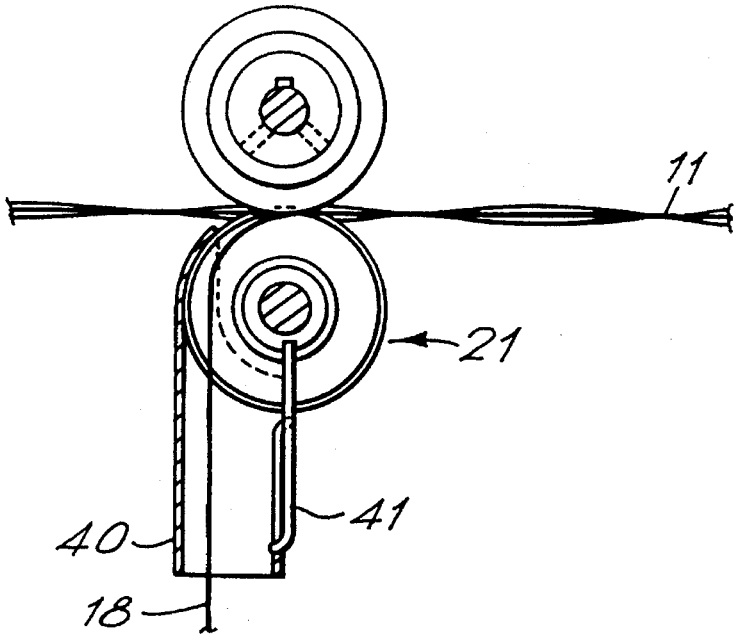
FIG. 5 is a view along arrows V—V in FIG. 4.

As can be seen from FIG. 4, as the travelling web 11 passes between the respective cutting wheels, the strips 18 are sheared from between the pockets 1 and from the edge of the web 11. The strips 18 which are now waste are removed by waste removal means 22 which comprise respective ducts 40 open at one end adjacent a respective set of cutting wheels and connected at its other end to a vacuum source, not shown. Respective fixed fingers 41 which extend along the radius of the respective cutting wheels 35,36 on the shaft 24 positively guide the strips 18 into the respective ducts 40.

The width of strip 18 cut away is chosen to give the desired overlap of the cover leaves in the finished package as will be described later.

From the cutting means 17 the respective strips 19 of infusion packages 1 pass vertically to transverse cutting device 50 for cutting the strips 19 transversely to form individual packages 1. The transverse cutting device 50 comprises a pair of co-rotating rolls 51,52 extending across the whole width of the slotted web 11. Each roll 51,52 comprises a transverse cutting blade 53 let into, and upstanding from its surface and an anvil 54. The cutting blades 53 co-operate with the anvils 54 to cut the strips 19 transversely. Roll 52 is mounted on a carriage 55 which is movable towards and away from the roll 51 by a mechanism 56, shown schematically, so as to obtain the correct cutting pressure. It will be clear that in each revolution of the rolls 51,52 two transverse cuts will be made. The speed of rotation of the rolls 51,52 varies cyclically during each revolution, as will be explained in further detail below.

After being cut from the travelling web 11, the packages 1 are attached to a web 70 of cover material, such as styrene, at welding means 100. The web 70 is fed to the welding means 100 at a constant speed. The web 70 first passes over a freely rotating pressure roller 71, pivotally mounted about an axis 72 and biased against the anvil roller 90 by spring means 73 and which maintains the web 70 in good contact with the anvil roller 90. The pressure roller 71 is provided with a rubber coating 74.

As it is conducted around the anvil roller 90, hinge lines 5 are introduced to the web 70 as by hinging means 80. The hinging means 80 comprises a rotary member 81 having a shaft 82 with a pair of notched perforating blades 83 mounted in and upstanding from the surface of the member 81. A cartridge heater 84 extends along the axis of the member 81 and heats the blades 83 which perforate the web both by the pressure exerted against the anvil roller 90, and also by melting the web material 70 locally. The member 81 is mounted on a carriage 85 which is adjustably movable towards and away from the anvil roller 90 by means shown schematically at 86. Thus, after it has passed between the rotary member 81 and the anvil roller 90, the web 70 will be formed, across its width, with rows of perforations which in the finished packages will form the hinge lines 5 about which the two leaves 3,4 of the cover 2 are joined.

From the hinging means 80, the web 70 passes around the anvil roller 90 to the welding means 100. The welding means 100 comprises a rotary shaft 101 on which are mounted diametrically opposed pairs of welding tips 102, clamped between respective plates 103 and which co-operate with the anvil roller 90 to produce a weld. A cartridge heater 104 extends along the axis of the shaft 101 and heats the tips 102. The rotation of the shaft 101 of the welding means 100 is synchronised with that of the rotating hinging member 81 such that the weld in the web 70 is formed in a desired position with respect to the hinge line 5 in the web. Furthermore the shaft 101 is mounted in a carriage 105 which is movable towards and away from the anvil roller 90 by means 106, so as to be able to vary the contact pressure with the anvil roller 90.

Packages 1 cut from the strips 19 of infusion containing pockets by the transverse cutting device 50 are fed vertically by accelerating means 60 to the nip between the welding tips 102 and the anvil roller 90. As stated earlier, the packages 1 should be travelling at the same speed as the web at the welding means 100 to ensure a satisfactory weld between the package 1 and the web 70. Since the speed of the packages 1 through the transverse cutting device 50 is approximately half that of the web 70, the packages 1 must be accelerated by a factor of approximately 2. The acceleration means 60 comprises a driven shaft 61 on which are mounted friction drive tires 62. The tires 62 span the gaps 20 formed between the adjacent strips 19 of packages 1 to grip on the sealed peripheries 8 of the packages. Freely rotating pressure wheels 63 co-operate with the tires 62 on the opposite side of the strips 19. The wheels 63 are mounted in a carriage 64, loaded by spring means 65 to maintain good contact with the strips 19 and thus ensure a positive drive by the tires 62.

The ends of a row of packages 1 are fed into the nip between the respective tires 62 and wheels 63 just before the packages are cut by the transverse cutting device 50. At this time the tires 62 are rotating with a surface speed equal to that of the speed of supply of the strips 19 of packages. However, once the packages 1 have been cut from the strips 19, the tires 62 are accelerated, so as to accelerate the packages 1 to the speed of the web 70. In fact, for stability reasons, the packages are first accelerated slightly above the web speed and then decelerated to the web speed for passage through the welding means 100. The packages 1 are still held by the tires 62 and wheels 63 as they fall into the nip between the anvil roller 90 and the welding tips 102 where they are welded together to accurately control their position in the web 70. It will be appreciated that by accelerating the packages 1, the accelerating means 60 also introduces the necessary longitudinal spacing between the packages. It will also be clear that the rotation of the shaft 61 of the acceleration means 60 is suitably synchronised with that of the welding means 100 so that the packages 1 are presented to be welded in the correct position, which is just to the rear of the hinge line 5 (see FIG. 8).

Once a transverse row of packages 1 is released by the tires 62 and wheels 63, the tires are again decelerated to the speed of the strips 19 of infusion packages before the next row of packages 1 enters the nip between them. The rotation of the transverse cutting rollers 51,52 is synchronised with that of the accelerating means 60 whereby the speed of the rollers is increased between cuts. This allows larger diameter rollers 51,52 to be used which improves the rigidity of the system.

Figure 8:
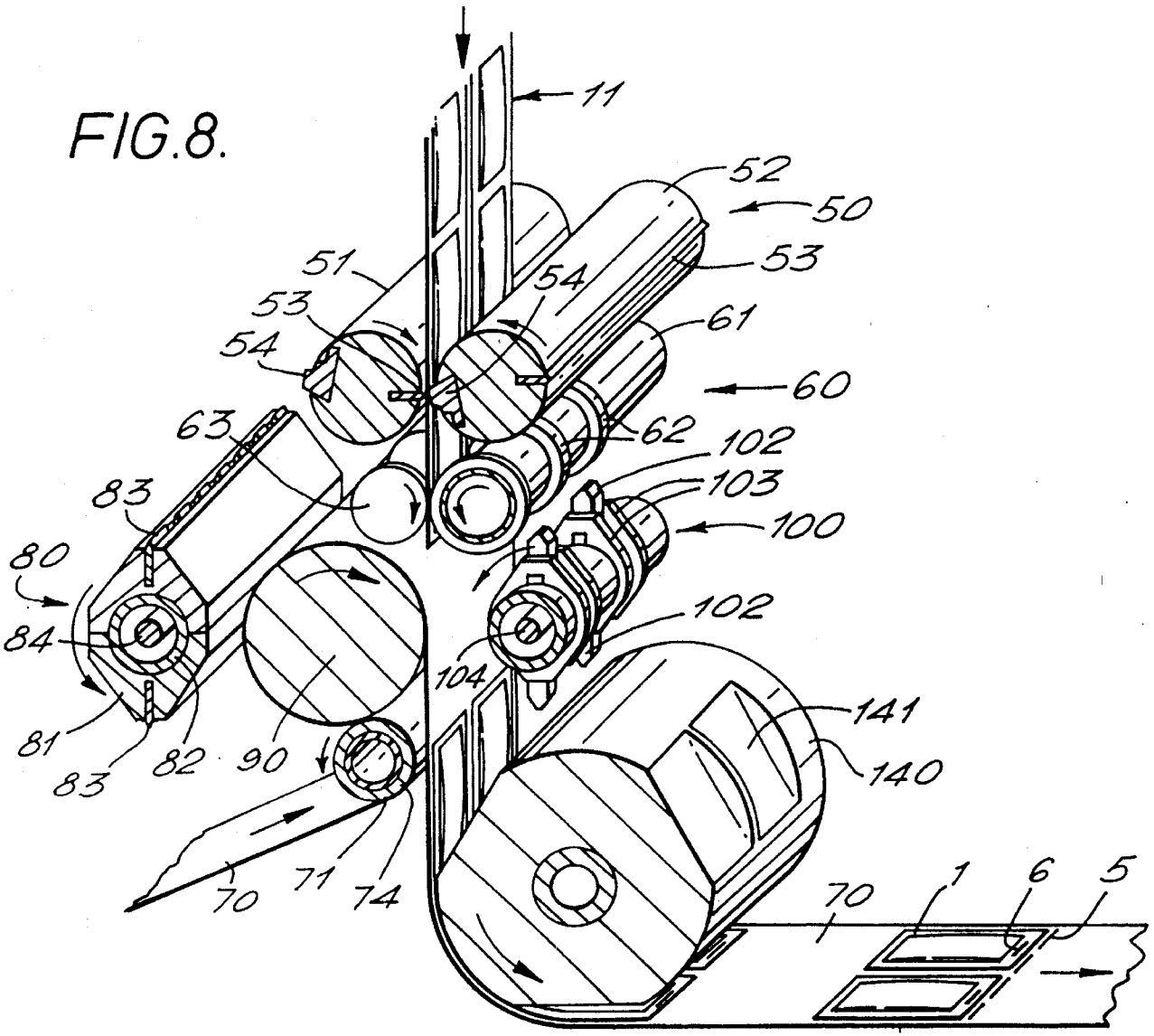
FIG. 8 is a perspective view of the components of FIG. 7.

As will be seen from FIG. 8, the web 70 leaves the welding means 100 having rows of packages 1 welded to it at the desired transverse and longitudinal spacings. The web 70 is turned through 90°, to run horizontally, around a roller 140 which has a plurality of equiangularly spaced peripheral pockets 141 for accommodating the packages 1.

To form individual, covered, packages the web is then cut both longitudinally and transversely. The web 70 is fed by conveyor 114 to longitudinal cutting means 110 comprising co-rotating cutting wheels 112,113, which slit the web 70 between the packages, and remove any excess side trim, which is removed by a vacuum duct 115. Preferably the slit is formed by crush cutting, with a peripheral cutting edge on wheel 112 co-operating under pressure with a surface on an anvil roller 113.

The strips of web so formed are then conveyed to the transverse cutting means 120. The cutting means 120 may comprise an anvil roller 122 and a rotating cutter roller 121 having a cutting blade extending along its surface for cutting the webs into individual lengths.

The individual packages are then conveyed by conveyor 123 to a folding station 130 which comprises a cam 131 which lifts to guide the front edge of the front leaf 3 of the cover into a curved guide 132 and then retracts. As the package 1 passes under the guide 132, the leaf 3 of the cover is folded back over the package about the hinge line 5. A sponge covered roller 134 consolidates the fold. The individual, covered, packages may then be packaged in any convenient manner.

It is of course possible that the edges of the cover 2 may be sealed to each other prior to packaging if a sealed package is required.

I claim:

1. A method of manufacturing infusion packages provided with a cover which projects laterally beyond the package and has a pair of joined leaves, comprising the steps of forming in a travelling two-ply porous web, successive rows of infusion containing pockets extending transversely to the direction of travel of the web and spaced apart by transversely extending sealed regions of the web, removing a continuous strip of web material from the longitudinal sealed region extending between respective pockets of said rows to form a plurality of parallel transversely spaced travelling strips of infusion pockets, cutting said strips along the transversely extending sealed regions to form the pockets into individual infusion packages, and attaching a cover to said packages.

2. A method as claimed in claim 1 wherein said travelling web is continuously moving.

3. A method as claimed in claim 1 or 2 wherein said continuous strip of web material is cut from between adjacent pockets.

4. A method as claimed in claim 3 wherein said continuous strip is cut by shear cutting.

5. A method as claimed in claim 3 wherein said continuous strip of web material is conducted away from the region of cutting.

6. A method as claimed in claim 5 wherein said strip of web material is conducted away by vacuum.

7. A method as claimed in claim 1 wherein packages cut from said strip of infusion pockets are attached to a cover web which is then cut transversely to produce individual covered packages.

8. A method as claimed in claim 7 wherein said cover web extends across a plurality of strips of infusion containing pockets, the packages cut from these strips being attached to the web of cover material in parallel rows across the web which is then cut both transversely and longitudinally to produce individual covered packages.

9. A method as claimed in claim 1 wherein the packages are heat sealed onto the cover.

10. A method as claimed in claim 1 wherein a web of cover material is fed to a rotary attachment means at constant speed, and packages cut from a strip of infusion containing pockets are accelerated to match the speed of said web such that they travel through said attachment means at the same speed.

11. Apparatus for manufacturing infusion packages each having a cover which projects laterally beyond the package and has a pair of joined leaves, comprising means for forming in a travelling two-ply web successive rows of infusion containing pockets extending transversely to the direction of travel of the web and spaced apart by transversely extending sealed regions of the web, means for removing a continuous strip of web material from the longitudinal sealed region between the respective pockets of each row to form a plurality of parallel, transversely spaced travelling strips of infusion containing pockets, means for cutting said strips along said transversely extending sealed regions to form individual infusion packages, and means for attaching covers to said packages.

12. Apparatus as claimed in claim 11 comprising means for continuously feeding said travelling web of infusion containing pockets.

13. Apparatus as claimed in claim 11 or 12 comprising cutting means for cutting said strip of web material from between adjacent infusion containing pockets.

14. Apparatus as claimed in claim 13 wherein said cutting means are shear cutting means comprising co-rotating cutters having co-operating shear cutting edges.

15. Apparatus as claimed in claim 13 or 14 comprising means for conducting a cut strip away from said cutting means.

16. Apparatus as claimed in claim 15 wherein said conducting means comprises vacuum means.

17. Apparatus as claimed in claim 11 comprising means for attaching packages to a web of cover material which is cut transversely to produce individual covered packages.

18. Apparatus as claimed in claim 17 comprising means for attaching packages cut from respective strips of infusion-containing pockets to a web of cover material spanning a plurality of said strips, and means for cutting said web longitudinally and transversely to produce individual covered packages.

19. Apparatus as claimed in claim 11 comprising means for heat sealing or welding said packages onto said covers.

20. Apparatus as claimed in claim 19 wherein said heat sealing or welding means comprises a heated rotary member co-operating under pressure with a counter-member, between which said package and cover pass.

21. Apparatus as claimed in claim 20 wherein said cover is supplied to said heat sealing means as a continuous web at a constant speed, and comprising means to accelerate the packages to the speed of said web so that the packages and the web pass through the heat sealing means at the same speed.

* * * * *